US006481248B2

(12) United States Patent
Willis

(10) Patent No.: US 6,481,248 B2
(45) Date of Patent: Nov. 19, 2002

(54) WASHER AND DRYER APPARATUS

(76) Inventor: Kevin J. Willis, 200 Tarlton Dr., Apt #818, Natchitoches, LA (US) 71457

( * ) Notice: Subject to any disclaimer, the term of this patent is extended or adjusted under 35 U.S.C. 154(b) by 54 days.

(21) Appl. No.: 09/737,789

(22) Filed: Dec. 15, 2000

(65) Prior Publication Data

US 2002/0073745 A1 Jun. 20, 2002

(51) Int. Cl.[7] ..... D06F 23/00
(52) U.S. Cl. ..... 68/19.2; 68/20; 68/23 R
(58) Field of Search ..... 68/20, 19.2, 23 R, 68/13 R, 17 R

(56) References Cited

U.S. PATENT DOCUMENTS 3,841,117 A * 10/1974 Crivilles
3,922,891 A * 12/1975 Sundstrom, Jr.
4,007,612 A * 2/1977 Brimer
4,202,187 A * 5/1980 Hukuzawa et al.
4,262,870 A * 4/1981 Kretchman et al.
4,819,460 A * 4/1989 Obradovic
4,903,508 A * 2/1990 Durazzani et al.
4,909,580 A * 3/1990 Mitchell
4,972,687 A * 11/1990 Czech et al.
5,074,131 A * 12/1991 Hirose et al.
5,165,260 A * 11/1992 Geriger
5,207,764 A * 5/1993 Akabane et al.
5,257,516 A * 11/1993 Hossfield

* cited by examiner

*Primary Examiner*—Frankie L. Stinson

(57) ABSTRACT

A washer and dryer apparatus for combining the functions of washing and drying clothes in one machine. The washer and dryer apparatus includes a cabinet-like assembly including a cabinet-like member having front, side, back, top, and bottom walls and further having feet members being securely attached thereto for stabilizing the cabinet-like member; and also includes a dryer assembly being disposed in the cabinet-like member; and further includes a washer assembly being disposed in the cabinet-like member.

20 Claims, 3 Drawing Sheets

WASHER AND DRYER APPARATUS

BACKGROUND OF THE INVENTION

1. Field of the Invention

The present invention relates to a clothes washer and dryer and more particularly pertains to a new washer and dryer apparatus for combining the functions of washing and drying clothes in one machine.

2. Description of the Prior Art

The use of a clothes washer and dryer is known in the prior art. More specifically, a clothes washer and dryer heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,832,750; 4,270,281; 5,220,813; 5,718,130; Des. 374,521; 5,457,969; and 5,111,673.

While these devices fulfill their respective, particular objectives and requirements, the aforementioned patents do not disclose a new washer and dryer apparatus. The inventive device includes a cabinet-like assembly including a cabinet-like member having front, side, back, top, and bottom walls and further having feet members being securely attached thereto for stabilizing the cabinet-like member; and also includes a dryer assembly being disposed in the cabinet-like member; and further includes a washer assembly being disposed in the cabinet-like member.

In these respects, the washer and dryer apparatus according to the present invention substantially departs from the conventional concepts and designs of the prior art, and in so doing provides an apparatus primarily developed for the purpose of combining the functions of washing and drying clothes in one machine.

SUMMARY OF THE INVENTION

In view of the foregoing disadvantages inherent in the known types of clothes washer and dryer now present in the prior art, the present invention provides a new washer and dryer apparatus construction wherein the same can be utilized for combining the functions of washing and drying clothes in one machine.

The general purpose of the present invention, which will be described subsequently in greater detail, is to provide a new washer and dryer apparatus which has many of the advantages of the clothes washer and dryer mentioned heretofore and many novel features that result in a new washer and dryer apparatus which is not anticipated, rendered obvious, suggested, or even implied by any of the prior art clothes washer and dryer, either alone or in any combination thereof.

To attain this, the present invention generally comprises a cabinet-like assembly including a cabinet-like member having front, side, back, top, and bottom walls and further having feet members being securely attached thereto for stabilizing the cabinet-like member; and also includes a dryer assembly being disposed in the cabinet-like member; and further includes a washer assembly being disposed in the cabinet-like member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new washer and dryer apparatus which has many of the advantages of the clothes washer and dryer mentioned heretofore and many novel features that result in a new washer and dryer apparatus which is not anticipated, rendered obvious, suggested, or even implied by any of the prior art clothes washer and dryer, either alone or in any combination thereof.

It is another object of the present invention to provide a new washer and dryer apparatus which may be easily and efficiently manufactured and marketed.

It is a further object of the present invention to provide a new washer and dryer apparatus which is of a durable and reliable construction.

An even further object of the present invention is to provide a new washer and dryer apparatus which is susceptible of a low cost of manufacture with regard to both materials and labor, and which accordingly is then susceptible of low prices of sale to the consuming public, thereby making such washer and dryer apparatus economically available to the buying public.

Still yet another object of the present invention is to provide a new washer and dryer apparatus which provides in the apparatuses and methods of the prior art some of the advantages thereof, while simultaneously overcoming some of the disadvantages normally associated therewith.

Still another object of the present invention is to provide a new washer and dryer apparatus for combining the functions of washing and drying clothes in one machine.

Yet another object of the present invention is to provide a new washer and dryer apparatus which includes a cabinet-like assembly including a cabinet-like member having front, side, back, top, and bottom walls and further having feet members being securely attached thereto for stabilizing the cabinet-like member; and also includes a dryer assembly being disposed in the cabinet-like member; and further includes a washer assembly being disposed in the cabinet-like member.

Still yet another object of the present invention is to provide a new washer and dryer apparatus that allows the user to have less space for one machine capable of performing both washing and drying functions.

Even still another object of the present invention is to provide a new washer and dryer apparatus that allows apartment dwellers to have the convenience of having a washer and dryer in one's space-limited apartment.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
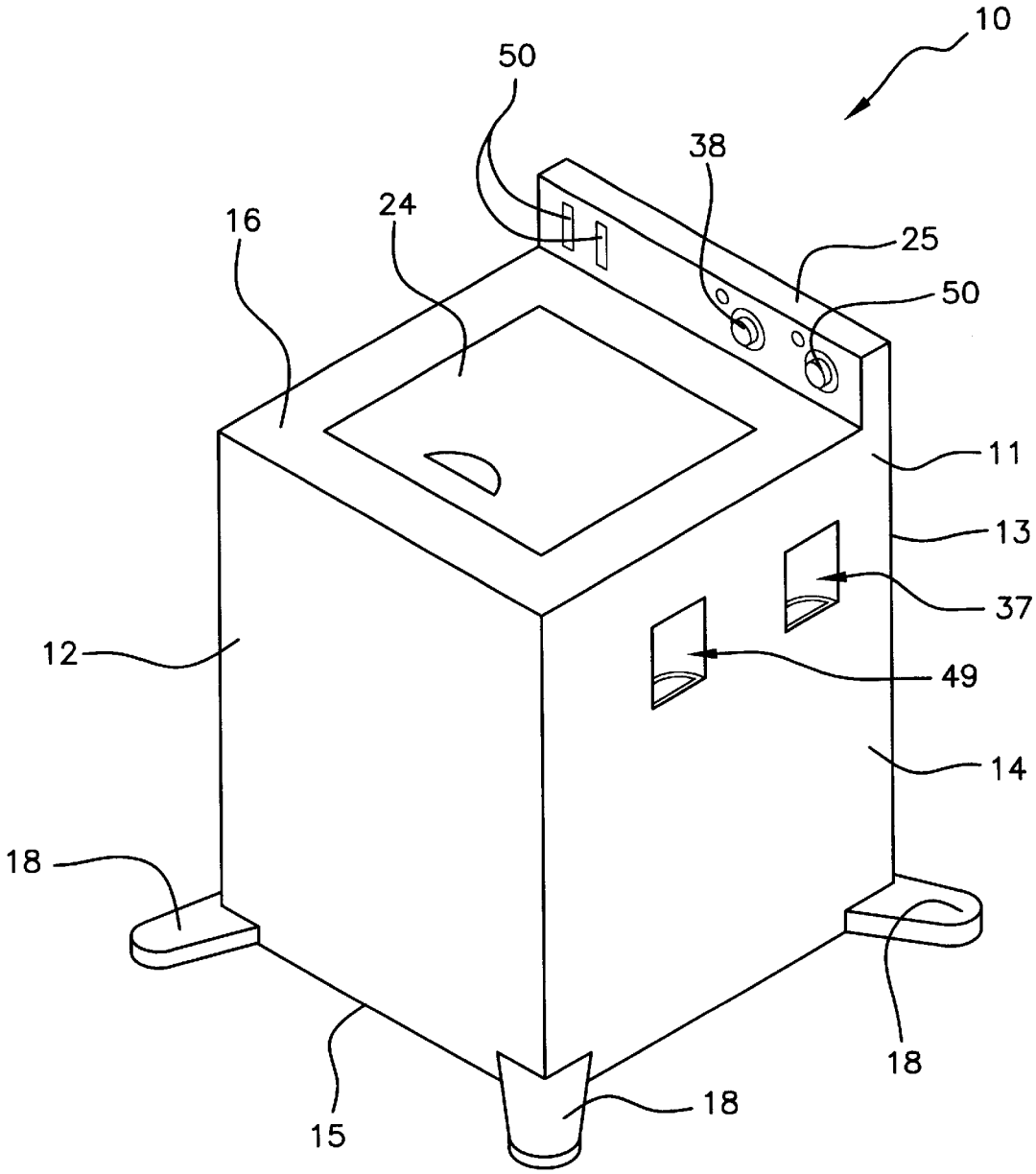
FIG. 1 is a perspective view of a new washer and dryer apparatus according to the present invention.
Figure 2:
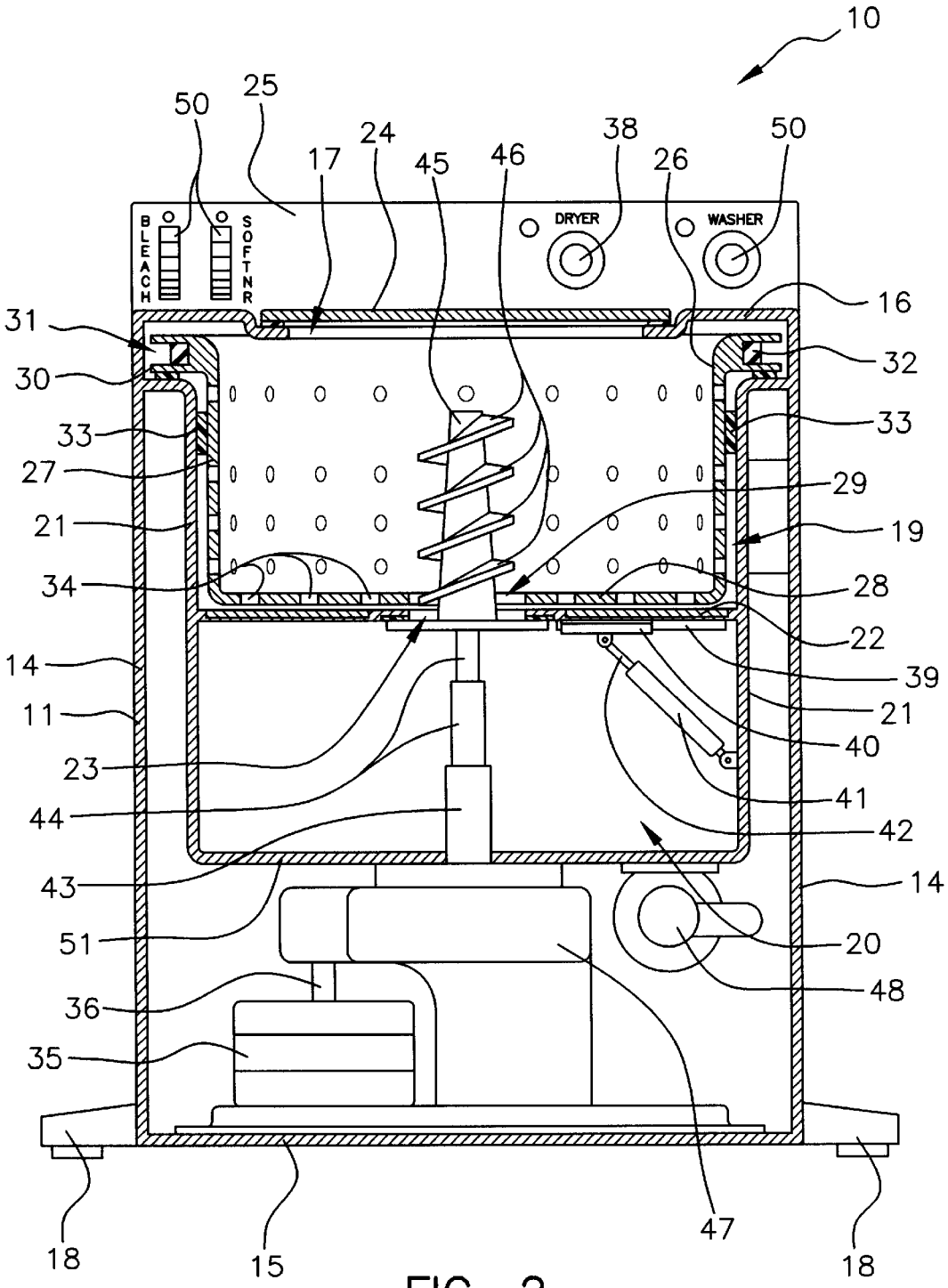
FIG. 2 is a cross-sectional view of the present invention showing the positioning of the agitator during washing.
Figure 3:
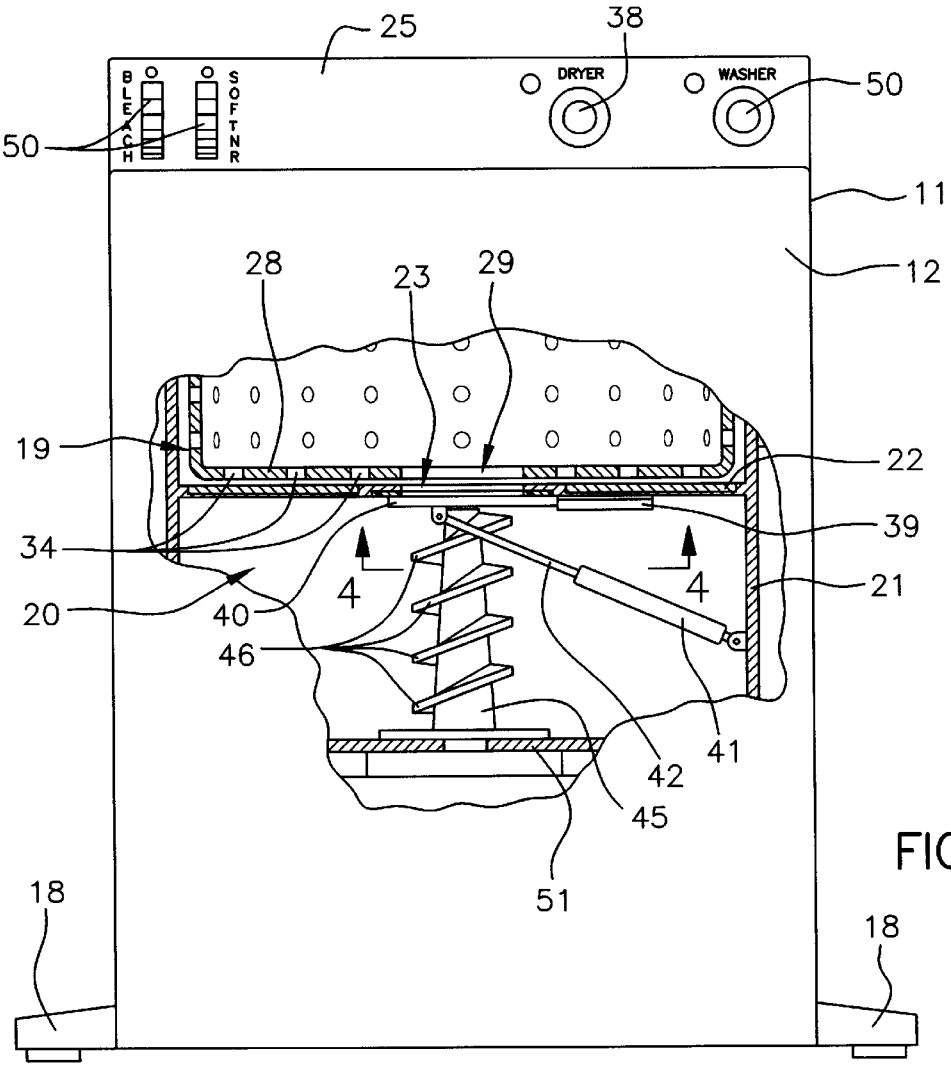
FIG. 3 is a partial cutaway side elevational view of the present invention showing the positioning of the agitator during drying.
Figure 4:
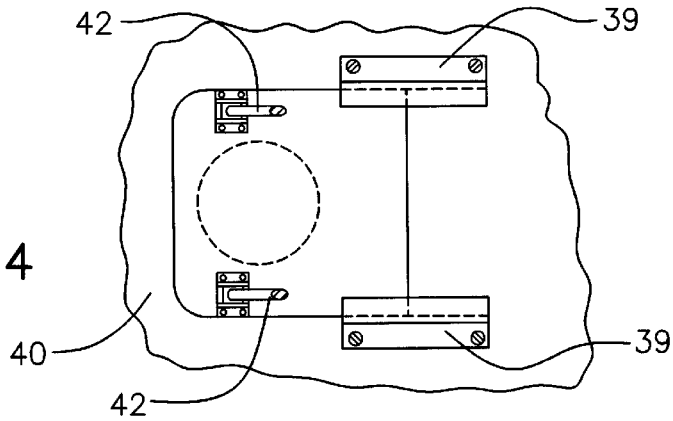
FIG. 4 is a bottom elevational view of the cover member of the present invention.

With reference now to the drawings, and in particular to FIGS. 1 through 4 thereof, a new washer and dryer apparatus embodying the principles and concepts of the present invention and generally designated by the reference numeral 10 will be described.

As best illustrated in FIGS. 1 through 4, the washer and dryer apparatus 10 generally comprises a cabinet-like assembly including a cabinet-like member 11 having front 12, side 14, back 13, top 16, and bottom 15 walls and further having feet members 18 being securely and conventionally attached thereto for stabilizing the cabinet-like member 11. The cabinet-like member 11 further includes a compartment 19,20 disposed therein and also includes an opening 17 being disposed through the top wall 16. The cabinet-like assembly further includes a door 24 being hingedly attached along an edge forming the opening 17 and being adapted to close over the opening 17 through the top wall 16. The compartment 19,20 is separated with an intermediate wall 22 thus forming an upper compartment 19 and a lower compartment 20. The intermediate wall 22 has an opening 23 being disposed therethrough. The cabinet-like assembly further includes a console 25 being conventionally disposed upon the top wall 16 and being integral to the back wall 13 of the cabinet-like member 11.

A dryer assembly is disposed in the cabinet-like member 11. The dryer assembly includes a clothes-holding drum 26 being rotatably disposed in the upper compartment 19 of the cabinet-like member 11 and having side 27 and bottom 28 walls with an opening 29 being disposed through the bottom wall 28. The opening 29 of the clothes-holding drum 26 is aligned with the opening 23 of the intermediate wall 28. The clothes-holding drum 26 further has a rim 30 being disposed about the side wall 27 at a top thereof and having a circumferential groove 31 being disposed therein. The dryer assembly also includes bearings 33 being conventionally disposed between the clothes-holding drum 26 and a side wall 21 of the upper compartment 19. The dryer assembly further includes a motor 35 being conventionally disposed inside the cabinet-like member 11 and having a motor shaft 36 rotatably and conventionally connected to the motor 35, and also includes a belt 32 being disposed in the circumferential groove 31 and being conventionally connected to the motor shaft 36 for rotation of the clothes-holding drum 26, and further includes a dryer control switch 38 being conventionally mounted upon the console 25 and being conventionally connected to the motor 35 for the energizing of the motor 35 to rotate the clothes-holding drum 26, and also includes heating elements 34 being conventionally disposed in the upper compartment 19 between the clothes-holding drum 26 and the intermediate wall 22. The dryer assembly also includes tracks 39 being securely and conventionally attached to an underside of the intermediate wall 22, and further includes a cover member 40 being slidably mounted upon the tracks 39 and being sealingly closeable over the openings 23,29 of the intermediate wall 22 and the bottom wall 28 of the clothes-holding drum 26, and also includes a cover member mover assembly being securely and pivotally attached to the cover member 40 and to the cabinet-like member 11. The cover member mover assembly includes cylindrical members 41 being securely and conventionally attached inside the lower compartment 20, and also includes arms 42 being movably disposed in and extendable from the cylindrical members 41 and being pivotally attached to the cover member 40. The dryer assembly further includes a heat exhaust port 37 being disposed through a side wall 14 of the cabinet-like member 11 to allow steam to escape the clothes-holding drum 26.

A washer assembly is disposed in the cabinet-like member 11. The washer assembly includes a telescoping agitator support assembly 43,44 being securely and conventionally attached to a bottom wall 51 of the lower compartment 20, and also includes an agitator member 45 being rotatably and conventionally mounted upon the telescoping agitator support assembly 43,44 and having flighting 46 being securely and conventionally disposed about an exterior of the agitator member 46, and further includes a transmission 47 being conventionally disposed in the cabinet-like member 11 and being conventionally connected to the telescoping agitator support assembly 43,44 and being conventionally connected to the motor shaft 36 for rotation of the agitator member 45, and also includes a water pump 48 being conventionally disposed in the cabinet-like member 11 and being conventionally connected to the clothes-holding drum 26 and being adapted to be connected to a water supply, and further includes a washer control switch assembly 50 being conventionally mounted upon the console 25 and being conventionally connected to the motor 35 and to the water pump 48, and also includes a detergent receiving port 49 being disposed in a side wall 14 of the cabinet-like member 11 and being conventionally connected to the clothes-holding drum 26. The telescoping agitator support assembly 43,44 includes a tubular base member 43 which is conventionally attached to the transmission 47, and also includes at least one telescoping tubular member 44 which is movably disposed in and extendable from the tubular base member 43 and which is conventionally attached to the agitator member 45 for raising and lowering the agitator member 45 into and out of the clothes-holding drum 26 through the openings 23,29 in the intermediate wall 22 and the bottom wall 28 of the clothes-holding drum 26.

In use, the user can wash one's clothes by turning on the washer control switch assembly 50 which automatically open the cover member 40 and raises the agitator member 45 into the clothes-holding drum 26 which also seals the openings 23,29 through the bottom wall 28 of the clothes-holding drum 26 and through the intermediate wall 22. Once finished washing, the agitator member 45 lowers into the lower compartment 20, and the cover member 40 seals over the openings 23,29 of the clothes-holding drum 26 and the intermediate wall 22, and user can dry ones' clothes by turning on the dryer control switch 38 which energizes the heating elements 34 and the rotation of the clothes-holding drum 26, all without the user having to move one's clothes from one machine to another machine.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A washer and dryer apparatus comprising:

a cabinet-like assembly including a cabinet-like member having front, side, back, top, and bottom walls and further having feet members being securely attached thereto for stabilizing said cabinet-like member;

a dryer assembly being disposed in said cabinet-like member; and a washer assembly being disposed in said cabinet-like member;

wherein said cabinet-like member further includes a compartment disposed therein and also includes an opening being disposed through said top wall, said cabinet-like assembly further including a door being hingedly attached along an edge forming said opening and being adapted to close over said opening through said top wall, said compartment being separated with an intermediate wall thus forming an upper compartment and a lower compartment, said intermediate wall having an opening being disposed therethrough.

2. A washer and dryer apparatus as described in claim 1, wherein said cabinet-like assembly further includes a console being disposed upon said top wall and being integral to said back wall of said cabinet-like member.

3. A washer and dryer apparatus as described in claim 1, wherein said dryer assembly includes a clothes-holding drum being rotatably disposed in said upper compartment of said cabinet-like member and having side and bottom walls with an opening being disposed through said bottom wall, said opening of said clothes-holding drum being aligned with said opening of said intermediate wall, said clothes-holding drum further having a rim being disposed about said side wall at a top thereof and having a circumferential groove being disposed therein, said dryer assembly also including bearings being disposed between said clothes-holding drum and a side wall of said upper compartment.

4. A washer and dryer apparatus as described in claim 3, wherein said dryer assembly further includes a motor being disposed inside said cabinet-like member and having a motor shaft rotatably connected to said motor, and also includes a belt being disposed in said circumferential groove and being connected to said motor shaft for rotation of said clothes-holding drum, and further includes a dryer control switch being connected to said motor for the energizing of said motor to rotate said clothes-holding drum, and also includes heating elements being disposed in said upper compartment between said clothes-holding drum and said intermediate wall.

5. A washer and dryer apparatus as described in claim 4, wherein said washer assembly includes a telescoping agitator support assembly being securely attached to a bottom wall of said lower compartment, and also includes an agitator member being rotatably mounted upon said telescoping agitator support assembly and having flighting being securely disposed about an exterior of said agitator member, and further includes a transmission being disposed in said cabinet-like member and being connected to said telescoping agitator support assembly and being connected to said motor shaft for rotation of said agitator member, and also includes a water pump being disposed in said cabinet-like member and being connected to said clothes-holding drum and being connected to a water supply, and further includes a washer control switch assembly being connected to said motor and to said water pump, and also includes a detergent receiving port being disposed in a side wall of said cabinet-like member and being connected to said clothes-holding drum.

6. A washer and dryer assembly as described in claim 5, wherein said telescoping agitator support assembly includes a tubular base member which is attached to said transmission, and also includes at least one telescoping tubular member which is movably disposed in and extendable from said tubular base member and which is attached to said agitator member for raising and lowering said agitator member into and out of said clothes-holding drum through said openings in said intermediate wall and said bottom wall of said clothes-holding drum.

7. A washer and dryer apparatus as described in claim 3, wherein said dryer assembly also includes tracks being securely attached to an underside of said intermediate wall, and further includes a cover member being slidably mounted upon said tracks and being sealingly closeable over said openings of said intermediate wall and said bottom wall of said clothes-holding drum, and also includes a cover member mover assembly being securely attached to said cover member and to said cabinet-like member.

8. A washer and dryer apparatus as described in claim 7, wherein said cover member mover assembly includes cylindrical members being securely attached inside said lower compartment, and also including arms being movably disposed in and extendable from said cylindrical members and being attached to said cover member.

9. A washer and dryer apparatus as described in claim 3, wherein said dryer assembly further includes a heat exhaust port being disposed through a side wall of said cabinet-like member to allow steam to escape said clothes-holding drum.

10. A washer and dryer apparatus comprising:

a cabinet-like assembly including a cabinet-like member having front, side, back, top, and bottom walls and further having feet members being securely attached thereto for stabilizing said cabinet-like member, said cabinet-like member further including a compartment disposed therein and also including an opening being disposed through said top wall, said cabinet-like assembly further including a door being hingedly attached along an edge forming said opening and being adapted to close over said opening through said top wall, said compartment being separated with an intermediate wall thus forming an upper compartment and a lower compartment, said intermediate wall having an opening being disposed therethrough, said cabinet-like assembly further including a console being disposed upon said top wall and being integral to said back wall of said cabinet-like member;

a dryer assembly being disposed in said cabinet-like member, said dryer assembly including a clothes-holding drum being rotatably disposed in said upper compartment of said cabinet-like member and having side and bottom walls with an opening being disposed through said bottom wall, said opening of said clothes-holding drum being aligned with said opening of said intermediate wall, said clothes-holding drum further having a rim being disposed about said side wall at a top thereof and having a circumferential groove being disposed therein, said dryer assembly also including bearings being disposed between said clothes-holding drum and a side wall of said upper compartment, said dryer assembly further including a motor being disposed inside said cabinet-like member and having a motor shaft rotatably connected to said motor, and also including a belt being disposed in said circumferential groove and being connected to said motor shaft for rotation of said clothes-holding drum, and further including a dryer control switch being mounted upon said console and being connected to said motor for the energizing of said motor to rotate said clothes-holding drum, and also including heating elements being disposed in said upper compartment between said clothes-holding drum and said intermediate wall, said dryer assembly also including tracks being securely attached to an underside of said intermediate wall, and further including a cover member being slidably mounted upon said tracks and being sealingly closeable over said openings of said intermediate wall and said bottom wall of said clothe-holding drum, and also including a cover member mover assembly being securely attached to said cover member and to said cabinet-like member, said cover member mover assembly including cylindrical members being securely attached inside said lower compartment, and also including arms being movably disposed in and extendable from said cylindrical members and being attached to said cover member, said dryer assembly further including a heat exhaust port being disposed through a side wall of said cabinet-like member to allow steam to escape said clothes-holding drum; and a washer assembly being disposed in said cabinet-like member, said washer assembly including a telescoping agitator support assembly being securely attached to a bottom wall of said lower compartment, and also including an agitator member being rotatably mounted upon said telescoping agitator support assembly and having flighting being securely disposed about an exterior of said agitator member, and further including a transmission being disposed in said cabinet-like member and being connected to said telescoping agitator support assembly and being connected to said motor shaft for rotation of said agitator member, and also including a water pump being disposed in said cabinet-like member and being connected to said clothes-holding drum and being connected to a water supply, and further including a washer control switch assembly being mounted upon said console and being connected to said motor and to said water pump, and also including a detergent receiving port being disposed in a side wall of said cabinet-like member and being connected to said clothes-holding drum, said telescoping agitator support assembly including a tubular base member which is attached to said transmission, and also including at least one telescoping tubular member which is movably disposed in and extendable from said tubular base member and which is attached to said agitator member for raising and lowering said agitator member into and out of said clothes-holding drum through said openings in said intermediate wall and said bottom wall of said clothes-holding drum.

11. A washer and dryer apparatus comprising:

a cabinet assembly including a cabinet member having front, side, back, top, and bottom walls;

a dryer assembly being disposed in said cabinet member; and a washer assembly being disposed in said cabinet member;

wherein said cabinet member includes a compartment disposed therein and an opening being disposed through said top wall, said compartment being separated with an intermediate wall thus forming an upper compartment and a lower compartment, said intermediate wall having an opening being disposed therethrough.

12. A washer and dryer apparatus as described in claim 11, wherein said cabinet assembly includes a door being hingedly attached along an edge forming said opening in said top wall of said cabinet member and being adapted to close over said opening in said top wall, and a console being disposed upon said top wall and being integral to said back wall of said cabinet member.

13. A washer and dryer apparatus as described in claim 11, wherein said dryer assembly includes a clothes-holding drum being rotatably disposed in said upper compartment of said cabinet member and having side and bottom walls with an opening being disposed through said bottom wall, said opening of said clothes-holding drum being substantially aligned with said opening of said intermediate wall.

14. A washer and dryer apparatus as described in claim 13, wherein said clothes-holding drum has a rim being disposed about said side wall at a top thereof and having a circumferential groove being disposed therein, and wherein said dryer assembly includes a motor being disposed inside said cabinet member, a motor shaft rotatably connected to said motor, a belt being disposed in said circumferential groove and being connected to said motor shaft for rotation of said clothes-holding drum, and heating elements being disposed in said upper compartment between said clothes-holding drum and said intermediate wall.

15. A washer and dryer apparatus as described in claim 14, wherein said washer assembly includes a telescoping agitator support assembly attached to a bottom wall of said lower compartment, an agitator member being rotatably mounted upon said telescoping agitator support assembly and having flighting being disposed about an exterior of said agitator member, and a transmission being disposed in said cabinet member and being connected to said telescoping agitator support assembly and being connected to said motor shaft for rotation of said agitator member.

16. A washer and dryer assembly as described in claim 15, wherein said telescoping agitator support assembly includes a tubular base member attached to said transmission, at least one telescoping tubular member movably disposed in and extendable from said tubular base member and which is attached to said agitator member for raising and lowering said agitator member into and out of said clothes-holding drum through said openings in said intermediate wall and said bottom wall of said clothes-holding drum.

17. A washer and dryer apparatus as described in claim 13, wherein said dryer assembly also includes tracks attached to an underside of said intermediate wall, a cover member slidably mounted upon said tracks and being sealingly closeable over said opening of said intermediate wall and said bottom wall of said clothes-holding drum, and a cover member mover assembly being attached to said cover member and to said cabinet member.

18. A washer and dryer apparatus as described in claim 17, wherein said cover member mover assembly includes cylindrical members attached inside said lower compartment and arms movably disposed in and extendable from said cylindrical members and being attached to said cover member.

19. A washer and dryer apparatus as described in claim 13, wherein said dryer assembly further includes a heat exhaust port being disposed through a side wall of said cabinet member to allow steam to escape said clothes-holding drum.

20. A washer and dryer assembly as described in claim 15 wherein said washer assembly includes a water pump being disposed in said cabinet member and being connected to said clothes-holding drum for connecting to a water supply, a washer control switch assembly being connected to said motor and to said water pump, and a detergent receiving port being disposed in a side wall of said cabinet member and being connected to said clothes-holding drum.

* * * * *